US007719400B1

(12) United States Patent
Bernier et al.

(10) Patent No.: US 7,719,400 B1
(45) Date of Patent: May 18, 2010

(54) METHOD AND APPARATUS FOR FLEXIBLE TEMPERATURE SENSOR HAVING COILED ELEMENT

(75) Inventors: Peter David Bernier, Minneapolis, MN (US); Audeen Richetto, Maple Grove, MN (US)

(73) Assignee: RTD Company, Ham Lake, MN (US)

( * ) Notice: Subject to any disclaimer, the term of this patent is extended or adjusted under 35 U.S.C. 154(b) by 775 days.

(21) Appl. No.: 11/462,020

(22) Filed: Aug. 2, 2006

Related U.S. Application Data

(60) Provisional application No. 60/705,143, filed on Aug. 2, 2005.

(51) Int. Cl.
*H01C 3/04* (2006.01)

(52) U.S. Cl. ..... 338/25; 338/28

(58) Field of Classification Search ..... 338/25
See application file for complete search history.

(56) References Cited

U.S. PATENT DOCUMENTS

| | | | |
|---|---|---|---|
| 2,530,256 | A | 11/1950 | Malek |
| 2,749,753 | A | 6/1956 | Adams |
| 2,758,294 | A | 8/1956 | Duncan |
| 2,802,925 | A | 8/1957 | Seelen et al. |
| RE24,436 | E | 2/1958 | Jacobson et al. |
| 2,945,265 | A | 7/1960 | Sell, Jr. et al. |
| 2,994,219 | A | 8/1961 | Schaschl |
| 3,049,012 | A | 8/1962 | Daniels |
| 3,165,426 | A | 1/1965 | Beckam |
| 3,343,589 | A | 9/1967 | Holzl |
| 3,589,360 | A | 6/1971 | Sinclair |
| 4,289,553 | A | 9/1981 | Nolf |
| 4,369,795 | A | 1/1983 | Bicher |
| 4,419,169 | A | 12/1983 | Becker et al. |

(Continued)

FOREIGN PATENT DOCUMENTS

| | | |
|---|---|---|
| JP | 57-079689 | 5/1982 |

OTHER PUBLICATIONS

*Small Parts Inc.* http://www.smallparts.com/search/search.cfm, Information for Part No. SMT- 16-12, (Aug. 17, 2006), 1.

(Continued)

*Primary Examiner*—Lincoln Donovan
*Assistant Examiner*—Joselito Baisa
(74) *Attorney, Agent, or Firm*—Schwegman, Lundberg & Woessner, P.A.

(57) ABSTRACT

One example of the present subject matter includes a first elongate section having a first flexible conductor enveloped by a first jacket; a second elongate section having a second flexible conductor enveloped by a second jacket; and an sensor section having an elongate flexible tubular shape, the sensor section housing a resistance temperature detector element which is at least partially coiled and which is resistance welded to the first flexible conductor at a first weld and to the second flexible conductor at a second weld; wherein the sensor section at least partially envelops and overlaps the first elongate section and the second elongate section, with a first band crimping the sensor section to the first elongate section, and a second band crimping the sensor section to the second elongate section, and with the first and second welds disposed between the first and second bands.

20 Claims, 4 Drawing Sheets

U.S. PATENT DOCUMENTS

| | | | | |
|---|---|---|---|---|
| 4,527,909 | A | 7/1985 | Dale et al. | |
| 4,553,023 | A | 11/1985 | Jameson et al. | |
| 4,607,154 | A | 8/1986 | Mills | |
| 4,827,487 | A | 5/1989 | Twerdochlib | |
| 4,848,926 | A | 7/1989 | Jenkins | |
| 4,977,385 | A | 12/1990 | McQueen | |
| 4,994,780 | A | 2/1991 | McQueen | |
| 5,221,916 | A | 6/1993 | McQueen | |
| 5,460,041 | A | 10/1995 | Andes et al. | |
| 5,666,593 | A | 9/1997 | Amico | |
| 5,749,656 | A | 5/1998 | Boehm et al. | |
| 5,769,622 | A | 6/1998 | Aoki et al. | |
| 5,831,511 | A | 11/1998 | Manning et al. | |
| 5,833,688 | A | 11/1998 | Sieben et al. | |
| 5,889,460 | A * | 3/1999 | Bachmann et al. | 338/28 |
| 5,906,584 | A | 5/1999 | Pavoni et al. | |
| 5,955,960 | A | 9/1999 | Monnier | |
| 5,959,524 | A | 9/1999 | Wienand et al. | |
| 5,999,081 | A | 12/1999 | Hannigan et al. | |
| 6,028,382 | A | 2/2000 | Blalock et al. | |
| 6,078,830 | A | 6/2000 | Levin et al. | |
| 6,117,088 | A | 9/2000 | Kreizman et al. | |
| 6,123,675 | A | 9/2000 | Kreizman et al. | |
| 6,162,184 | A | 12/2000 | Swanson et al. | |
| 6,213,995 | B1 | 4/2001 | Steen et al. | |
| 6,322,559 | B1 | 11/2001 | Daulton et al. | |
| 6,354,735 | B2 | 3/2002 | Thermos et al. | |
| 6,440,129 | B1 | 8/2002 | Simpson | |
| 6,456,863 | B1 | 9/2002 | Levin et al. | |
| 6,547,788 | B1 | 4/2003 | Maguire et al. | |
| 6,623,821 | B1 | 9/2003 | Kendig | |
| 6,666,578 | B2 | 12/2003 | Gibbs et al. | |
| 6,698,922 | B2 | 3/2004 | Adachi et al. | |
| 6,738,566 | B2 | 5/2004 | Pagnella | |
| 6,977,575 | B2 | 12/2005 | Bernier et al. | |
| 6,986,746 | B2 | 1/2006 | Fox et al. | |
| 6,991,370 | B2 | 1/2006 | Kofune et al. | |
| 7,029,173 | B2 | 4/2006 | Engel et al. | |
| 7,090,645 | B2 | 8/2006 | Fox et al. | |
| 7,361,830 | B2 | 4/2008 | Richetto et al. | |
| 2002/0048312 | A1 | 4/2002 | Schurr et al. | |
| 2002/0198465 | A1 | 12/2002 | Fox et al. | |
| 2003/0050634 | A1 | 3/2003 | Ellman et al. | |
| 2003/0209264 | A1 | 11/2003 | Richetto et al. | |
| 2004/0094706 | A1 | 5/2004 | Covey et al. | |
| 2004/0114665 | A1 | 6/2004 | Park et al. | |
| 2004/0233034 | A1 | 11/2004 | Bernier | |
| 2004/0238023 | A1 | 12/2004 | Richetto et al. | |
| 2006/0247726 | A1 | 11/2006 | Biggs et al. | |
| 2006/0284722 | A1 | 12/2006 | Bernier | |
| 2009/0026894 | A1 | 1/2009 | Lesmeister et al. | |
| 2009/0044849 | A1 | 2/2009 | Richetto et al. | |

OTHER PUBLICATIONS

"U.S. Appl. No. 10/391,531, Amendment and Response filed Oct. 18, 2007 to Final Office Action mailed Apr. 23, 2007", 10 pgs.

"U.S. Appl. No. 10/391,531, Amendment and Response filed Feb. 26, 2007 to Non-Final Office Action mailed Aug. 29, 2006", 10 pgs.

"U.S. Appl. No. 10/391,531, Final Office Action mailed Apr. 23, 2007", 19 pgs.

"U.S. Appl. No. 10/391,531, Non-Final Office Action mailed Aug. 29, 2006", 18 pgs.

"U.S. Appl. No. 10/391,531, Notice of Allowance mailed Nov. 28, 2007", 9 pgs.

"U.S. Appl. No. 10/801,496, Non Final Office Action mailed Aug. 13, 2008", 13 pgs.

"U.S. Appl. No. 11/312,240, Response filed Jul. 7, 2008 to Non-Final Office Action mailed Apr. 4, 2008", 7 pgs.

"U.S. Appl. No. 11/312,240 Non-Final Office Action mailed Mar. 1, 2007", 7 pgs.

"U.S. Appl. No. 11/312,240 Response filed Aug. 1, 2007 to Non-Final Office Action mailed Mar. 1, 2007", 12 pgs.

"U.S. Appl. No. 11/312,240, Non-Final Office Action mailed Apr. 4, 2008", 5 pgs.

"Fluoroplastic Heat Shrink Tubing", http://www.texloc.com, (Dec. 26, 2001), 3 pgs.

"Heat Shrink Tubing—Frequently Asked Questions", http://www.advpoly.com/Products/PrintFAQ.aspx?Title=Heat%20Shrink%20Tubing%20-%20Frequently%20Asked%20Questions&ProductName=Heat%20Shrink%20Tubing, Advanced Polymers, Inc., (2007), 1 pg.

"Melt Definition", *Webster's Third New International Dictionary*, [online] [retrieved Oct. 23, 2007]., (1993), 2 pgs.

"Thermocouples", http://web.archive.org/web/19990508063849/http://www.picotech.com/applications/thermocouple.html, Pico Technologies website, (May 8, 1999), 4 pgs.

Advanced Polymers Inc., "The World's Thinnest, Smallest, & Strongest Heat Shrink Tubing" brochure, 2 pgs.

Lomber, S. G, et al., "The Cryoloop: an adaptable reversible cooling deactivation method for behavioral or electrophysiological assessment of neural function", *Journal of Neuroscience Methods*, 86, (1999), 179-194.

Mark, S., "Using Thin-Wall Heat-Shrink Tubing in Medical Device Manufacturing", http://www.devicelink.com/mddi/archive/99/04/006.html., (Apr. 1999), 6 pgs.

Richetto, Audeen, et al., "Multi-Point Polymer Encapsulated Micro-Thermocouple", U.S. Appl. No. 60/455,617, filed Mar. 17, 2003, 18.

* cited by examiner

METHOD AND APPARATUS FOR FLEXIBLE TEMPERATURE SENSOR HAVING COILED ELEMENT

RELATED APPLICATION

This application claims the benefit under 35 U.S.C. 119(e) of U.S. Provisional Patent Application Ser. No. 60/705,143, filed Aug. 2, 2005, the entire disclosure of which is hereby incorporated by reference in its entirety.

TECHNICAL FIELD

The present subject matter relates generally to electric sensors for sensing ambient conditions and more particularly to method and apparatuses for coreless flexible temperature sensors having coiled elements.

BACKGROUND

Electronic sensors are known. Various sensors have become adapted for use in varying conditions. However, as technology evolves, there is an ever-present need for new configurations which are usable in new applications and new environments. In particular, the art presents a need for flexible sensors which can be applied in a robust manner. Some applications require a sensor which can sustain multiples flexes and high heat. Sensors which address these concerns should be configured for efficient and robust assembly.

SUMMARY

The above-mentioned problems and others not expressly discussed herein are addressed by the present subject matter and will be understood by reading and studying this specification.

One embodiment of the present subject matter includes a first elongate section having a first flexible conductor enveloped by a first polytetrafluoroethylene jacket; a second elongate section having a second flexible conductor enveloped by a second polytetrafluoroethylene jacket; and an sensor section having an elongate flexible tubular shape, and including polytetrafluoroethylene material, the sensor section housing a resistance temperature detector element which is at least partially coiled and which is resistance welded to the first flexible conductor at a first weld and to the second flexible conductor at a second weld; wherein the sensor section at least partially envelops and overlaps the first elongate section and the second elongate section, with a first band crimping the sensor section to the first elongate section, and a second band crimping the sensor section to the second elongate section, and with the first and second welds disposed between the first and second bands.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and therefore and not exhaustive, and the scope of the present subject matter is defined by the appended claims and their legal equivalents.

Figure 1:
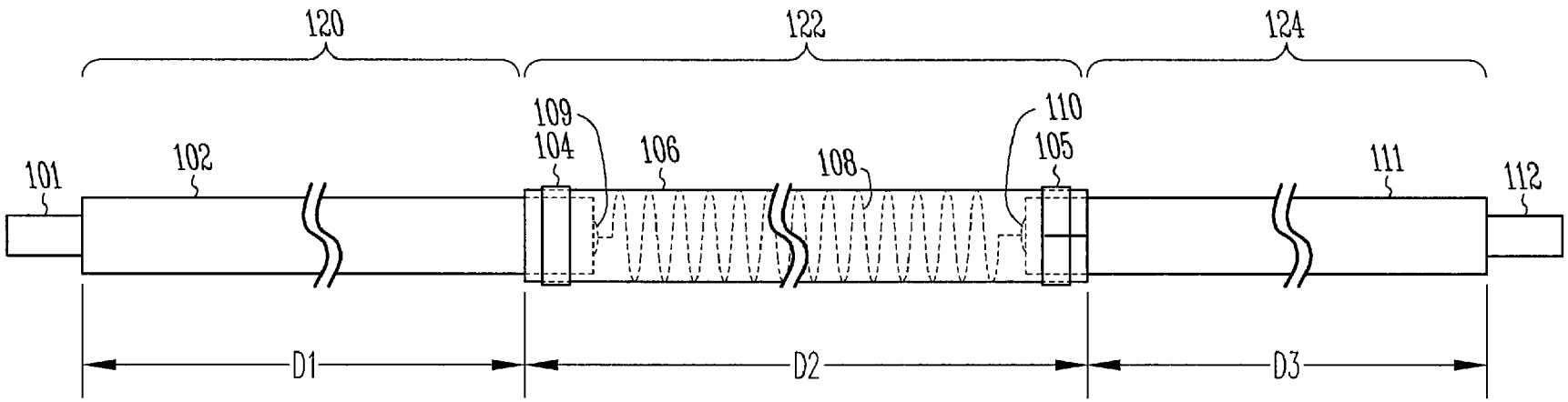
FIG. 1 shows a partial side-view of a sensor according to one embodiment of the present subject matter.

FIG. 1 shows a partial side-view of a sensor according to one embodiment of the present subject matter. In various embodiments, a sensor of the present subject matter has an elongate shape. For example, in various embodiments, the present subject matter includes a first section 120 extending along the dimension D1, a sensor section 122 extending along the dimension D2, and a second section 124 extending along the dimension D3. Each of these sections, in various embodiments, are interconnected. These sections have various lengths depending on their application. In one example embodiment, the dimensions of D1, D2, and D3 all are 18 inches. In other embodiments, each of the sections is tailored in length to suit an application.

Various embodiments include a first section 120 which includes a conductor. In some embodiments, round wire is used for the conductor. In additional embodiments, other conductors are used, such as flex wire, braided wire, or other types of conductors. Various embodiments include a conductive core 101 surrounded by an insulator 102. In one embodiment, the core 101 copper. Some embodiments include a core 101 which includes copper alloys. In some embodiments, the core is nickel plated copper. These materials demonstrate the present subject matter, and are not exhaustive or exclusive of the materials which are contemplated by the present subject matter. Other embodiments, including, but not limited to, aluminum conductor are also contemplated by the present subject matter. The second section 124 additionally includes a conductor, in various embodiments. In some embodiments, the second section 124 includes a core 112 surrounded by an insulator 111. Materials for core 101 are used for core 112, in various embodiments.

Various embodiments include insulators 102, 106, and 111. In some embodiments, the insulators 102, 106, and 111 are of identical materials. In additional embodiments, the insulators 102, 106, and 111 are not of identical materials. Various materials are contemplated by the present subject matter. Some embodiments include insulators having polytetrafluoroethylene ("PTFE"). One brand of polytetrafluoroethylene is TEFLON. TEFLON is a registered trademark of the E.I. DuPont de Nemours and Company Corporation, 101 West $10^{th}$ St., Wilmington, Del. 19898. Other brands are within the present subject matter. Additional blends including polytetrafluoroethylene are within the present subject matter. Polytetrafluoroethylene is a suitable material for use with the present subject matter due to its resistance to reaction with other chemicals, in various embodiments. As such, it is important to note that other materials, which are known to resist further reactions, also fall within the scope of the present subject matter.

Various embodiments include an insulator 102 which includes other materials. In some embodiments, an insulator is used which includes perfluoroalkoxy fluorocarbon ("PFA"). Some of these embodiments melt when heated. In some embodiments, this is advantageous, as a melting insulator could form to a mated feature, such as a band 104 or a wire 106. In various embodiments, and insulator is used which melts during manufacture, but does not melt in use.

Some embodiments include insulators which includes other materials. In some embodiments, an insulator is used which includes fluoroethylene-propylene ("FEP"). Some of these embodiments melt when heated. In some embodiments, this is advantageous, as a melting insulator could form to a mated feature, such as a band 104 or a wire 108. In various embodiments, and insulator is used which melts during manufacture, but does not melt in use.

Embodiments of the present subject matter include an which includes other materials. In some embodiments, an insulator is used which includes polyvinylchloride ("PVC").

The insulative materials listed herein are not exhaustive of exclusive of the present subject matter, and additional materials not listed herein expressly are also contemplated.

The first 120 and second 124 sections, in various embodiments, have a cylindrical shape. However, it is important to note that other shapes are possible, such as flat shapes, braided shapes, or other shapes.

Various embodiments of the present subject matter include a sensor section 122. In various embodiments, the sensor section 122 includes a sensor insulator 106 which is elongate. Some embodiments additionally include a sensor insulator 106 which is flexible. As such, the sensor section 122 is adapted to be elastically configured into a coil shape, in various embodiments. In some embodiments of the present subject matter, the sensor insulator 106 is tube shaped. In one embodiment, a sensor insulator is elongate and tubular, and is sized such that each of its ends can fit over another component. For example, in one embodiment, the sensor insulator is sleeved over the first section 120 and the second section 124. In such a configuration, various embodiments use an inner diameter of the tube such that a snug fit is accomplished. In one embodiment, the outer diameter of the sensor insulator 106 is approximately 0.098 inches.

Various embodiments of the present subject matter include a sensor element 108 which is at least partially housed by the sensor insulator 106. The sensor element 108 can be constructed from one or more of a range of materials, in various embodiments. Materials contemplated by the present subject matter include, but are not limited to, platinum, nickel, copper, iron, and combinations thereof. The present subject matter includes materials not expressly recited herein, which are suitable for use as a temperature sensor. In some embodiments of the present subject matter, a Nickel Iron material manufactured by BALCO is used. BALCO is a registered trademark of CRS Holdings, Inc., 209F Baynard Building, 3411 Silverside Rd., Wilmington, Del. 19810.

In housing the sensor element 108, some embodiments of the present subject matter use additional components attached to the sensor section 122. For example, in various embodiments, the sensor element 108 is interconnected between the first section 120 and the second section 124. The sensor element 108 of the present subject matter, in some embodiments, is adapted for use as an resistance temperature detector ("RTD").

In various embodiments, the sensor element 108 is welded to a conductor of the first section 120 with a first weld 109, and to a conductor or the second section 124 with a second weld 110. In some embodiments, the sensor element 108 is connected to core 101 and to core 112. Various interconnection means are within the present subject matter. For example, in some embodiments, the sensor element 108 is interconnected to one or more components using resistance welding. In additional embodiments, the sensor element 108 is interconnected to additional components using solder. Additional methods of interconnection suitable for forming a mechanical and an electrical interconnect fall within the present subject matter.

The sensor element 108, in various embodiments, is in a coil configuration as it extends at least part of the way along the sensor insulator 106. Such a configuration, in various embodiments, allows for increased flexibility along the sensor section 122. Embodiments which are not coiled, however, additionally fall within the present subject matter.

In some embodiments, the coils are spaced apart. In various embodiments, the coils are spaced apart such that they do not contact one another. Some RTD sensors operate when the coils are spaced apart, and when they are not touching one another. Coils may additionally be isolated from one another with a separator or another form of electrical isolative materials, in various embodiments.

To protect the sensor element 108, some embodiments seal the sensor section 122 to other components. For example, some embodiments are configured such that the sensor section 122 at least partially envelops and overlaps the first section 120 and the second section 124 in a sealable manner. Some embodiments include one or more insulators which are meltable, as disclosed herein, to seal the sensor section 122. Additional embodiments do not seal the sensor wire 108 in the sensor insulator 106.

Some of these embodiments use a first band 104 to crimp the sensor section 122 to the first section 120. In various embodiments, the first band 104 is brass. In additional embodiments, the band is another material including, but not limited to, steel, nickel, nickel plated brass. These materials are not exhaustive or exclusive of the present subject matter, and additional materials are contemplated. Some materials for bands are selected based on their strength. Materials, in some embodiments, are selected based on their reactivity to one or more chemicals. Some materials, in various embodiments, are selected based on their durability at certain temperatures. For example, some embodiments use a materials which is routinely exposed to around 260 degrees centigrade.

Some of these embodiments use a second band 105 to crimp the sensor section 122 to the second section 124. In the interest of protecting the welds, in various embodiments the first and second welds are disposed between the first and second bands. These bands provide strain relief for the sensor element 108, as stresses pulling on the first insulator 102 and the second insulator 111 are absorbed by the bands 104, 105 and the sensor insulator 106.

Some materials present problems with interconnection. For example, in some configurations, a first section 120 having a polytetrafluoroethylene jacket may present a low friction coefficient when fitted to a sensor section 122 constructed from polytetrafluoroethylene. As such, various embodiments of the present subject matter use various material preparation techniques to increase the friction coefficient. In one embodiment, the first section 120 is pretreated before interconnection to increase its coefficient of friction. In another embodiment, the sensor section 122 is pretreated to increase its coefficient of friction. Some embodiments treat both the first section 120 and the sensor section 122. Embodiments including treatments to the second section 124 additionally fall within the scope of the present subject matter. Embodiments having treatments improving the coefficient of friction can additionally be combined with banding, as described herein.

Various processes which increase the coefficient of friction are possible. For example, surface abrasion techniques are used. Some embodiments perform surface conditioning using TETRA-ETCH flouropolymer etchant. TETRA-ETCH is a registered trademark of W. L. Gore & Associates, Inc., which is a corporation of Delaware and which is located at 555 Paper Mill Road P.O. BOX 9329 Newark Del. 19714.

Other manufacturing processes are additionally taught by the present subject matter. As described herein, various embodiments of the present subject matter include a sensor element 108 which is at least partially coiled. In various embodiments, the sensor element is originally a substantially straight wire, and is wound into a coil shape. Some embodiments of the present subject matter wind the sensor element by winding it onto a mandrel. For example, in one embodiment, the mandrel is approximately 0.045 inches in diameter. Various coil configurations have a winding pitch which ranges from about 0.005 inches to about 0.200 inches. In one embodiment, the coil winding pitch is approximately 0.040 inches.

In some of these embodiments, a wound sensor element is removed from the mandrel and is used to construct a sensor of the present subject matter. In constructing the sensor into a use configuration suitable for market sales, this coil is pulled through the sensor insulator 106. In various embodiments, the fit between the sensor insulator 106 and the sensor element 108 is an interference fit. In some embodiments, the coil is not attached to the sensor insulator directly, but is rather attached to the entire assembly through connections to the first section 120 and the second section 124. A free floating configuration as such improves flexibility, in various embodiments.

Figure 2:
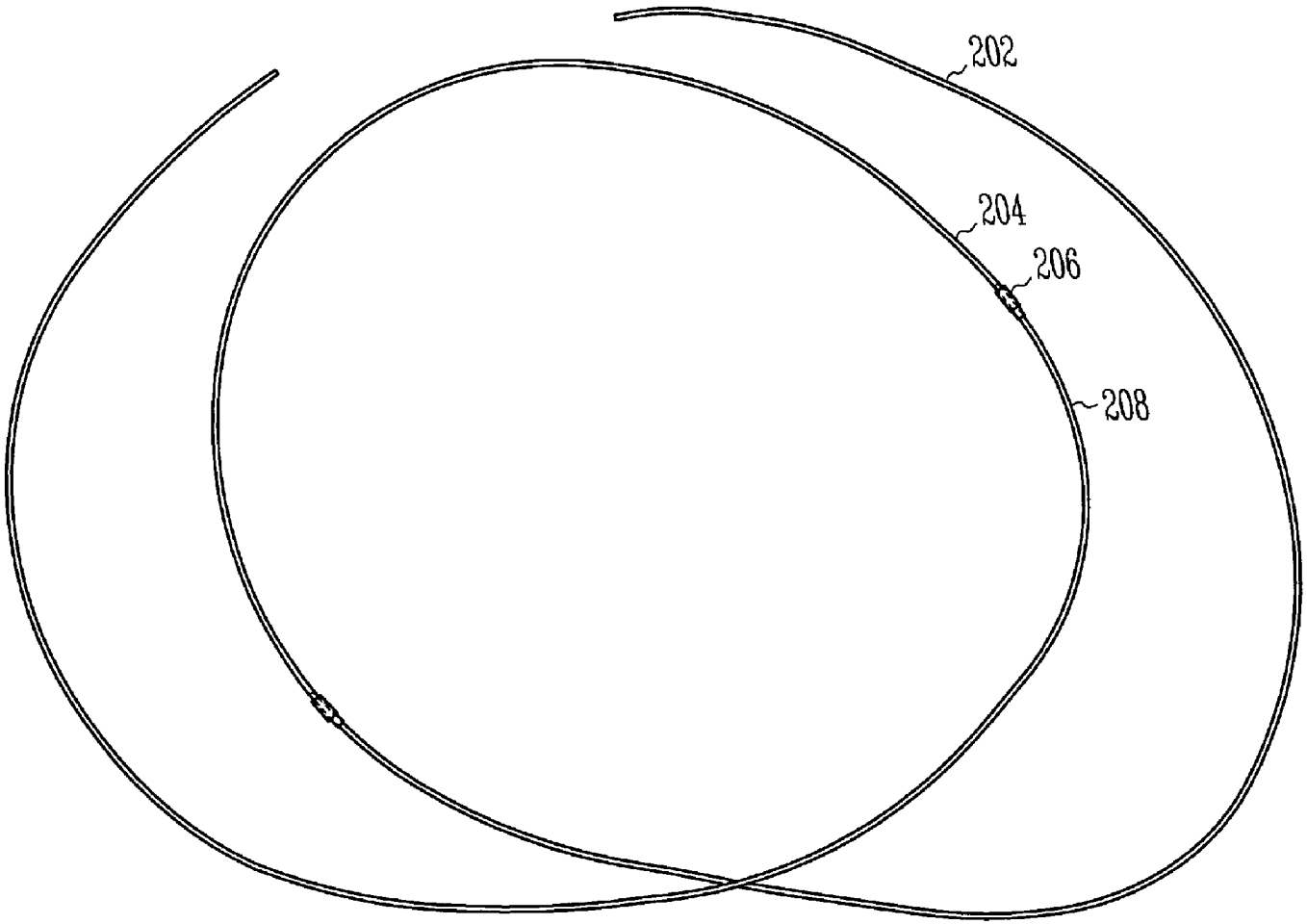
FIG. 2 shows a perspective view of a sensor according to one embodiment of the present subject matter.

FIG. 2 shows a perspective view of a sensor according to one embodiment of the present subject matter. Various embodiments of the present subject matter include a first section 202, a sensor insulator 204, a first band 206, and a second section 208.

Figure 3:
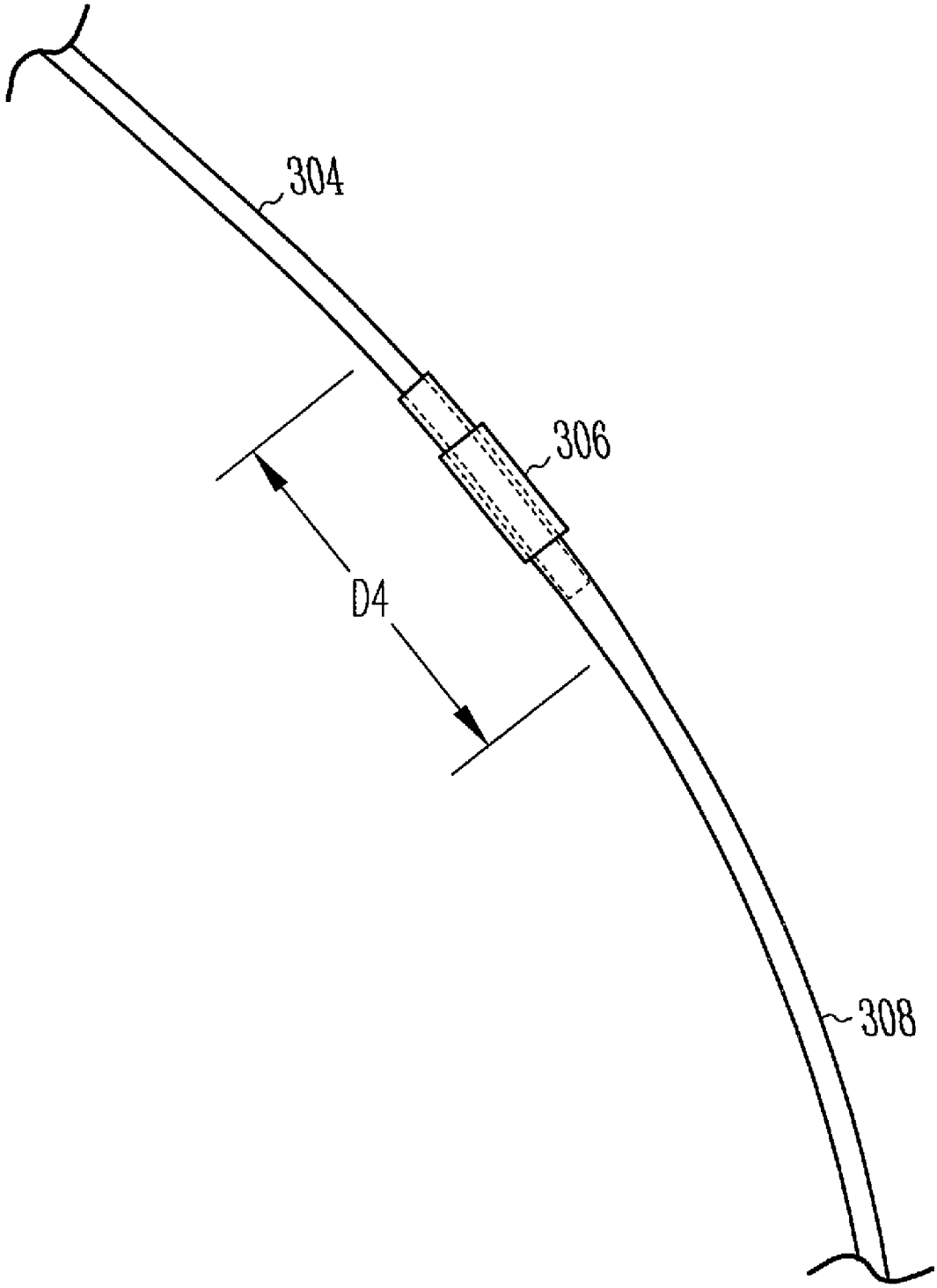
FIG. 3 shows a partial perspective view of a sensor according to one embodiment of the present subject matter.

FIG. 3 shows a partial perspective view of a sensor according to one embodiment of the present subject matter. Various embodiments of the present subject matter include a sensor insulator 304, a first band 306, and a second section 308. The illustration shows an overlap between the sensor insulator 304 and the second section 308 which extends a distance of D4.

Figure 4:
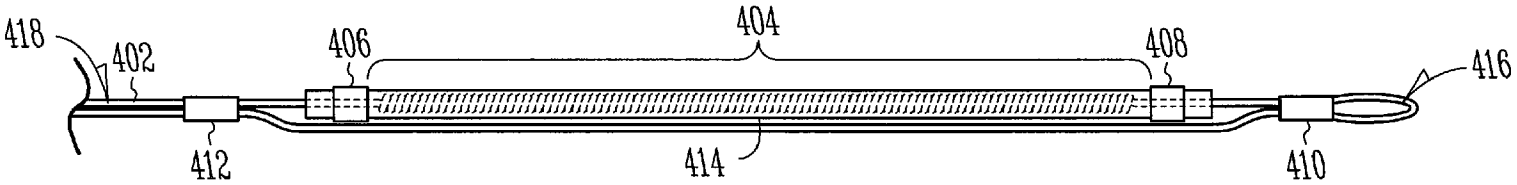
FIG. 4 shows a partial side-view of a sensor, according to one embodiment of the present subject matter.

FIG. 4 shows a partial side-view of a sensor, according to one embodiment of the present subject matter. Various embodiments include a wire 402. Additionally, various embodiments include a tube 414. In various embodiments, a sensor 404 extends through the tube 414. In various embodiments, the sensor 404 includes a coiled wire. Various embodiments band the tube 414 to the wire 402 with a first band 406 and a second band 408. In various embodiments, the bands 406, 408 are covered with tape. In some embodiments, the tape is KAPTON tape. KAPTON is a registered trademark of the E.I. DuPont de Nemours and Company Corporation, 101 West 10th St., Wilmington, Del. 19898.

In various embodiments, a third band 410 is provided, banding wire 402 unto itself. In some embodiments, the third band 410 is brass. In additional embodiments, the band is another material including, but not limited to, steel, nickel, nickel plated brass. These materials are not exhaustive or exclusive of the present subject matter, and additional materials are contemplated. Additional materials are possible, however. Some embodiments cover the third band 410 with KAPTON tape. In various embodiments, a fourth band 412 banding wire 402 unto itself. The materials in use for the third band can be used for the fourth band. In various embodiments, the fourth band 412 is covered with KAPTON tape. In some embodiments, the first piece of tape 410 is wrapped around wire 402 such that wire 402 and tape 410 define a hoop.

In various embodiments, by routing the wire 402 back along the sensor 414 so that the wire's origin and its termination are occur near the proximal side 418 of the sensor, the present subject matter enables a sensor to be used with communications electronics being disposed on a proximal side 418 of the sensor, as opposed to a design in which the wire does not loop back along the sensor, and instead terminates on a distal end of the sensor 416.

Figure 5:
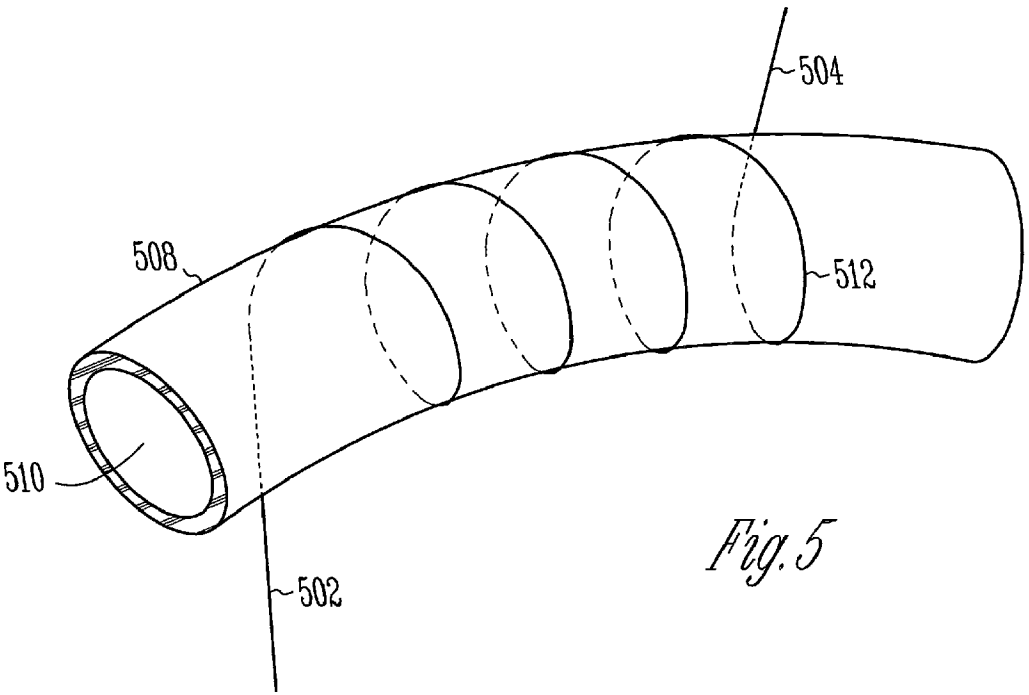
FIG. 5 shows a partial perspective view of a tube and a sensor, according to one embodiment of the present subject matter.

FIG. 5 shows a partial perspective view of a tube and a sensor, according to one embodiment of the present subject matter. Embodiments of the present subject matter are adapted to enable sensor flex in use. Various embodiments include a tube 508 around which is wrapped a sensor 512. In various embodiments, the tube is rubber. In some embodiments, the tube is corrugated metal. Braided metallic tubes are contemplated, in various embodiments. Embodiments including a tube with an inner rubber coating are additionally contemplated by the present subject matter. These configurations only demonstrate the present subject matter, and are not exhaustive or exclusive of the materials which are contemplated by the present subject matter. The sensor includes a first portion 502 and a second portion 504. The tube 508 has a lumen 510. In various embodiments, the tube 508 is flexible. In various embodiments, a sensor 512 is able to flex with the tube in use. Various embodiments pass a high temperature fluid through the lumen 510. In some embodiments, the fluid passing through the lumen 510 is heated to 260 degrees centigrade. In various embodiments, hot glue passes through the lumen 510.

In various embodiments, the present subject matter provides sensors for use in measuring ambient conditions. In particular, the present subject matter includes embodiments which use RTD to measure the temperature in various applications. The sensor element of the present subject matter, in various examples, is an RTD element.

The present subject matter is suited for a number of applications, including, but not limited to, determining, through sensing, an absolute temperature. Additional embodiments are concerned primarily with changes in temperatures. Thus, some embodiments, of the present subject matter provide an averaging temperatures sensor.

In sensing, various sensor element configurations are used. Some sensor elements provide for a resistance of approximately 284 Ohms at approximately 177 degrees Centigrade. Some of these designs provide for a resistance of 120 Ohms at 0 degrees Centigrade. Other values are within the present subject matter. For examples, some embodiments provide approximately 100 Ohms of resistance.

Sensors of the present subject matter are compatible with operation at a range of temperatures. Some embodiments of the present subject matter are suited for operation at approximately 260 degrees centigrade. Some of the present subject matter are suited for operation at greater than 260 degrees centigrade. Embodiments adapted to operate at these temperatures utilize the high temperature compatibility discussed herein with respect to several aspects of the design. For example, some embodiments include a sensor insulator made from a material which is compatible with such high temperatures.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. An apparatus, comprising:

a first elongate section having a first flexible conductor enveloped by a first polytetrafluoroethylene jacket;

a second elongate section having a second flexible conductor enveloped by a second polytetrafluoroethylene jacket; and an sensor section having an elongate flexible tubular shape, and including polytetrafluoroethylene material, the sensor section housing a resistance temperature detector element which is at least partially coiled and which is resistance welded to the first flexible conductor at a first weld and to the second flexible conductor at a second weld;

wherein the sensor section at least partially envelops and overlaps the first elongate section and the second elongate section, with a first band crimping the sensor section to the first elongate section, and a second band crimping the sensor section to the second elongate section, and with the first and second welds disposed between the first and second bands, wherein the sensor section has no core for support and the apparatus is adapted to enable sensor flex in use.

2. The apparatus of claim 1, wherein the at least partial coil of the resistance temperature detector element is coiled around a center axis of the sensor section housing.

3. The apparatus of claim 2, where the at least partial coil of the resistance temperature detector element includes a plurality of spaced apart coils.

4. The apparatus of claim 3, wherein the plurality of spaced apart coils are free floating within the sensor section housing.

5. The apparatus of claim 3, wherein the plurality of spaced apart coils have a winding pitch of from about 0.005 inches to about 0.200 inches.

6. The apparatus of claim 1, wherein the resistance temperature detector element is soldered to the first conductor and the second conductor.

7. The apparatus of claim 1, wherein a surface of at least the first jacket includes abrasions.

8. The apparatus of claim 1, wherein the sensor section housing is at least partially melted.

9. The apparatus of claim 1, further wherein the first flexible conductor is formed of an alloy that includes aluminum.

10. An apparatus, comprising:

a first conductor having a first insulative jacket;

a sensor section having an annular shape, the sensor section housing a resistance temperature detector element which includes a plurality of spaced apart coils arranged in a helix which are electrically connected to the first conductor and which are interference fitted to an interior wall of the sensor section housing; and a second conductor having a second insulative jacket, the second conductor electrically connected to the resistance temperature detector element, wherein the sensor section housing is connected to the first insulative jacket and to the second insulative jacket, and wherein the plurality of spaced apart coils have a winding pitch of from about 0.005 inches to about 0.200 inches and wherein the sensor section has no core for support and is adapted to be flexible in use.

11. The apparatus of claim 10, wherein the resistance temperature detector element is soldered to the first conductor and the second conductor.

12. The apparatus of claim 10, wherein the plurality of spaced apart coils are free floating within the sensor section housing.

13. The apparatus of claim 12, wherein the sensor element is welded to the first conductor with a first weld and the second conductor with a second weld.

14. The apparatus of claim 13, wherein the sensor section at least partially envelops and overlaps the first insulative jacket and the second insulative jacket, with a first band crimping the sensor section to the first insulative jacket, and a second band crimping the sensor section to the second insulative jacket.

15. The apparatus of claim 14, wherein the first and second welds are disposed between the first and second bands.

16. The apparatus of claim 10, wherein the sensor section housing includes polytetrafluoroethylene.

17. The apparatus of claim 16, wherein the first insulative jacket includes a polytetrafluoroethylene jacket which envelopes the first conductor, and the second insulative jacket includes a polytetrafluoroethylene jacket which envelopes the second conductor.

18. The apparatus of claim 10, wherein the spaced apart coils are not touching one another.

19. The apparatus of claim 10, wherein the sensor section housing includes perfluoroalkoxy fluorocarbon.

20. The apparatus of claim 19, wherein the sensor section housing is at least partially melted.

* * * * *